US005711631A

United States Patent [19]

Amon

[11] Patent Number: 5,711,631

[45] Date of Patent: Jan. 27, 1998

[54] METHOD OF ASPHALT PAVING AND PAVEMENT

[76] Inventor: Thomas Richard Amon, 219 Sunset Dr., Elkhorn, Wis. 53121

[21] Appl. No.: 604,645

[22] Filed: Feb. 21, 1996

Related U.S. Application Data

[63] Continuation-in-part of Ser. No. 191,443, Feb. 3, 1994, Pat. No. 5,494,373, which is a continuation of Ser. No. 980,359, Nov. 23, 1992, abandoned.

[51] Int. Cl.[6] ..... E01C 11/02

[52] U.S. Cl. ..... 404/74; 404/89

[58] Field of Search ..... 404/72, 74, 75, 404/77, 81, 82, 87, 89, 90, 93, 94, 95

[56] References Cited

U.S. PATENT DOCUMENTS

| | | | |
|---|---|---|---|
| 13,785 | 8/1855 | McClintock . | |
| 80,856 | 8/1868 | Caduc et al. . | |
| 93,142 | 7/1869 | Van Camp . | |
| 144,748 | 11/1873 | De Valin . | |
| 160,174 | 2/1875 | Filbert et al. . | |
| 184,101 | 11/1876 | Murphy . | |
| 189,337 | 4/1877 | Camp . | |
| 296,131 | 4/1884 | Campbell . | |
| 957,985 | 5/1910 | McClintock . | |
| 1,335,180 | 3/1920 | Morrison . | |
| 1,801,622 | 4/1931 | Blass | 404/89 |
| 1,926,895 | 9/1933 | Fischer | 404/89 |
| 1,939,341 | 12/1933 | Edge | 404/89 |
| 2,085,420 | 6/1937 | Day | 94/23 |
| 3,057,274 | 10/1962 | Janowitz | 404/74 |
| 3,605,579 | 9/1971 | Heltzel | 404/89 X |
| 3,801,211 | 4/1974 | Perkins | 404/75 |
| 3,866,384 | 2/1975 | Peterson, Jr. et al. | 404/74 X |
| 4,124,325 | 11/1978 | Cutler | 404/75 |
| 4,129,398 | 12/1978 | Schoelkopf | 404/90 X |
| 4,172,679 | 10/1979 | Wirtgen | 404/90 |
| 4,253,816 | 3/1981 | Tobias et al. | 425/385 |
| 4,780,022 | 10/1988 | Ohiba et al. | 404/90 |
| 5,007,765 | 4/1991 | Dietlein et al. | 404/74 |
| 5,176,426 | 1/1993 | Adamson | 299/39 |
| 5,494,373 | 2/1996 | Amon | 404/74 |

FOREIGN PATENT DOCUMENTS

| | | |
|---|---|---|
| 653323 | 3/1979 | U.S.S.R. . |
| 111080 | 12/1917 | United Kingdom . |

OTHER PUBLICATIONS

*Asphalt rubber tested in Caltrans I–86 project*, by Al France, Mar. 1989, p.52, Roads & Bridges.

*Sawcut and seal may prevent reflective cracks*, by Frank Raczon, Mar., 1989, pp. 49–51, Roads & Bridges.

*Primary Examiner*—James Lisehora

*Attorney, Agent, or Firm*—Michael, Best & Friedrich

[57] ABSTRACT

A process for paving a surface of a sub-base with compactable asphaltic concrete comprising aggregates and an asphaltic cement to provide a finished asphaltic pavement having dormant zones of potential fracture at predetermined locations. The process comprises the steps of forming a continuous mat of compactable asphaltic paving concrete having a predetermined thickness on the surface of a sub-base; creating dormant zones of potential fracture at predetermined locations in the mat prior to compacting the compactable asphaltic paving concrete; and compacting the mat of compactable asphalt concrete to seal the dormant zones and provide a finished asphaltic pavement of predetermined density having a smooth traffic bearing top surface with the sealed dormant zones of potential fracture substantially concealed therein.

19 Claims, 2 Drawing Sheets

METHOD OF ASPHALT PAVING AND PAVEMENT

RELATED APPLICATIONS

This patent application is a continuation-in-part of U.S. patent application Ser. No. 08/191,443, filed Feb. 3, 1994, now U.S. Pat. No. 5,494,373, which is a continuation of U.S. patent application Ser. No. 07/980,359, filed Nov. 23, 1992, now abandoned.

BACKGROUND OF THE INVENTION

The invention relates to a method of paving a sub-base with an asphalt concrete and the asphalt pavement produced thereby. More particularly, the invention relates to a method of asphalt paving a longitudinally extending continuous surface and creating a pavement having therein discrete dormant zones of potential fracture at predetermined positions.

Highways, roads, and sidewalks are frequently paved with a layer or mat of asphalt concrete which is laid over the surface of the sub-base. Typically, the asphalt concrete comprises asphalt cement combined with aggregates in a ratio of approximately 95 parts by weight of aggregate to approximately 5 parts by weight of liquid asphalt cement. The aggregate and liquid asphalt cement are heated and mixed to form an asphalt paving composition that includes some air voids.

The aggregate is usually a mixture of sand, gravel, and stone; the largest pieces of aggregate having a diameter equal to about ⅔ the thickness of the asphalt mat. Preferably, the aggregate has crushed particles to provide sharp edges in the gravel and stone which, when combined with the liquid asphaltic cement, create an aggregate interlock which improves the strength of the mat.

Other characteristics important in determining the quality of a particular aggregate mix are; first, the aggregate should be sound, i.e., it should be able to withstand a substantial amount of compression before it breaks apart; and second, the aggregate should have desirable wear characteristics, i.e., it should be resistant to friction and abrasion. Aggregates possessing these qualities can be expensive.

Typically, the liquid asphalt cement is a residue or by-product of the petroleum refinement process. In a newly refined state, it is generally very resilient, and when heated to the application temperature, becomes a thick, viscous liquid. The flexibility properties of the asphalt cement can be increased by blending less viscous oils to change the penetration index of the asphalt cement. This increases the cost of the asphalt cement and requires the use of fuels which may be better used as energy resources.

The usual process of laying a continuous longitudinally extending surface of asphalt mat such as on a highway or road, is well known in the art. The liquid asphaltic cement is heated to a temperature of approximately 250°–320° and mixed with the aggregate. The mixture is then spread evenly, typically about one lane at a time, by a paver or paving machine and is compressed or compacted to provide a traveling surface that, when cooled to ambient temperatures, is initially very flexible and resistant to wear. The longitudinal direction of travel of the paving machine creates natural longitudinal joints in the asphalt mat. Because of the mechanics of the paving process, i.e., the paving machine lays an asphalt mat that is approximately one lane wide, these longitudinal joints usually occur at the centerline of the mat or roadbed, between lanes or at the border between the road and the shoulder of the road.

Over time and with the change in seasons, the asphalt mat is exposed to a wide range of changing temperatures. As the temperature decreases, the asphalt mat contracts causing random transverse cracking as well as cracking at the longitudinal joints. When the temperature subsequently increases, the asphalt mat then expands. However, it expands randomly, and for reasons that are beyond the scope of this discussion, the mat does not return to its original size. Thus, when the mat expands there is less material to cover the same amount of sub-base and the cracks that developed during the period of decreased temperature remain. Though the transverse cracks appear randomly, empirical evidence suggests that the temperature induced cracks will eventually occur approximately every 10 to 20 feet and can be as wide as ¼ to ¾ of an inch. Over a period of years, additional cracks will appear at greater frequency (i.e., closer longitudinal intervals for the transverse cracks until some equilibrium is found between the stresses on the mat formed by the temperature changes and traffic, and the flexibility of the mat.

Another factor contributing to the cracking of the asphalt mat is the oxidation of the liquid asphaltic cement. The oxidation causes asphalt cement to become more brittle and less flexible over time. As the asphalt cement oxidizes, it becomes more brittle and prone to cracking under the constant and random stresses induced by traffic and temperature changes.

Cracks (both transverse and longitudinal) formed due to these stresses typically have large widths (¼ to ¾ of an inch) and reduce the service life of the pavement. Large width cracks introduce an additional wear factor because they allow water to easily seep into and underneath the asphalt mat in large volume. Because water expands when it freezes, it adds to the stress on the mat during periods of freezing and thawing. Therefore, wide cracks, which heretofore have been unavoidable, create a pavement that requires a high amount of expensive maintenance and one that deteriorates at a higher rate than one where cracks are narrow or non-existent.

Extensive efforts have been made over more than a century to solve this problem. It is known that by chemically modifying the asphalt cement it is possible to make the resulting pavement more flexible. However, modifying the asphalt cement substantially increases the cost of the asphalt cement. While these modifications provide some benefit, the durations of their usefulness is limited as they are still prone to oxidation and the resulting brittleness.

Prior efforts to solve the problem of random transverse cracking and longitudinal joint cracking in asphalt have also resulted in the use of what is termed the saw and seal technique typically used the asphalt overlay on existing concrete roadways. This technique makes use of the knowledge that reflective cracking will occur when an asphalt mat is placed over an existing concrete pavement. Accordingly, once the asphalt mat has been paved and has cooled, the mat is then sawed through in a transverse direction creating joints in the asphalt pavement directly over the cracks in the underlying concrete pavement to dictate where cracking will occur. The joints are then sealed with some type of silicone or tar sealant to prevent water from seeping into the cracks where it would develop into an additional maintenance factor as the water expands and contracts due to seasonal freezing and thawing. This is an effective way to contour cracking. However, saw and seal is a very time consuming and expensive procedure, so expensive in fact that it is not used on most highways.

Another effort to provide a crack resistant longitudinally extending asphalt mat has been to employ polymer science to improve the flexibility of the asphalt mat through chemically engineered additives. Chemical additives, in the volume needed are costly and the resulting pavement is nevertheless still subject to the oxidation and plasticization which, over time, takes place in the conventional asphalt mat to make it less flexible and more subject to cracking.

Thus, a need exists to provide an asphalt mat that is durable in that it is able to hold together and resist potholing, stable in that it is capable of resisting rutting, and yet, in an efficient, low-cost manner, minimizes the development of the wide random cracks (both transverse to the longitudinal direction of the roadbed and longitudinal joint cracks) that heretofore occurred in highways, roads, and sidewalks in an efficient low cost manner. Further, an asphalt mat is needed that minimizes moisture penetration even as the mat develops cracks and that is less dependent on high quality expensive aggregate to provide strength to resist cracking in the mat. It is also desirable to be able to attain the aforementioned characteristics in an asphalt pavement without using an expensive asphalt cement.

SUMMARY OF THE INVENTION

The invention provides a process for paving a surface of a sub-base with compactable asphaltic concrete comprising aggregates and an asphaltic cement to provide a finished asphaltic roadway pavement having dormant zones of potential fracture at predetermined locations. The method comprises the steps of; forming a continuous mat of compactable asphaltic paving concrete of a predetermined thickness on the sub-base surface, the mat extending longitudinally in the direction of the roadway; creating longitudinally extending open score lines in the mat prior to compacting the compactable asphaltic paving concrete; and compacting the mat of compactable asphalt concrete to close and seal the open score lines to create a plurality of sealed, spaced, parallel and longitudinally extending dormant zones of potential fracture and to provide a finished asphaltic pavement of predetermined density having a smooth traffic bearing top surface with the sealed dormant zones of potential fracture substantially concealed therein.

The invention also provides a finished asphaltic pavement produced by the claimed process of forming a mat of compactable asphaltic paving concrete on the sub-base surface. The asphalt mat formed by the claimed process includes sealed dormant zones of potential fracture at predetermined locations in the finished mat, preferably 0.3 to 15 feet apart and extending parallel to the longitudinal direction of the asphalt mat and parallel to the centerline of the road. The provision of the relatively closely spaced dormant zones of potential fracture allows a series of evenly spaced longitudinally extending hairline cracks to develop and this will reduce the amount and severity of the longitudinal joint cracking that normally occurs at the centerline, between traffic lanes, and at the longitudinal joint between the traffic lanes and the shoulder of the road. Though the mat will undergo the same degree of shrinkage during the freezing and thawing process, the provision of a larger number of dormant fracture zones will result in an increased number of hairline cracks each having a smaller width than those that occur in conventional asphalt mats. he advantage of these smaller cracks is that they tend to substantially reseal themselves as the summer road temperatures reach upwards of 150–180 degrees Fahrenheit causing the asphaltic cement to become soft and flow into the fracture to seal it. Also, the smaller cracks allow less moisture, dirt and debris to penetrate the asphalt where they would create additional maintenance problems.

DETAILED DESCRIPTION OF THE PREFERRED EMBODIMENT

Figure 1:
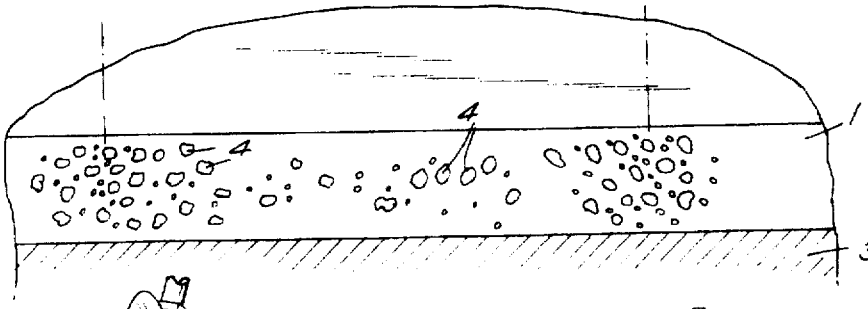
FIG. 1 of the drawings shows a perspective view of the still-warm, uncompacted asphalt mat.

Shown in FIG. 1 of the drawings is a warm, uncompressed, asphalt mat 1 provided by the process of forming a continuous unbroken longitudinally extending asphalt mat of compactable asphaltic paving concrete. Asphaltic paving concrete is laid over a sub-base 3 by conventional paving methods to provide an asphalt mat 1 having a predetermined thickness, as required by the intended use of the asphalt surface. The particular method of laying the hot asphalt cement on the sub-base to create a smooth compactable asphalt mat may include the use of a conventional mechanical paver or simply involve manually shoveling the warm asphalt concrete from a container onto the surface of the sub-base and smoothing by manual means. In any event, the particular methods of spreading and smoothing the compactable asphaltic paving concrete on the sub-base are well known in the art, form no part of the invention and, accordingly, will not be described in detail.

Also shown in FIG. 1, and as seen in the cross section of the asphalt mat 1, are the individual particles comprising the aggregate 4 of the typical asphalt mat. Preferably, the aggregate 4 is a mixture of sand, gravel, and stone; the largest pieces of the aggregate having a diameter equal to about ⅔ the thickness of the asphalt mat. Conventional asphalt paving aggregate 4 is derived from crushed granite, limestone or gravel. These sources of aggregate are preferred because they provide sharp, compound edges which when mixed in the liquid asphaltic cement tend to create an aggregate interlock that provides strength to the paved surface. In particular, an example of aggregate interlock can be seen in FIG. 2A of the drawings. As shown in the lower, unscored portion of FIG. 2A, the larger and smaller size fractions of the aggregate are, under normal conditions, uniformly distributed in interlocked relation in the mat that is formed by the paving process.

Figure 2:
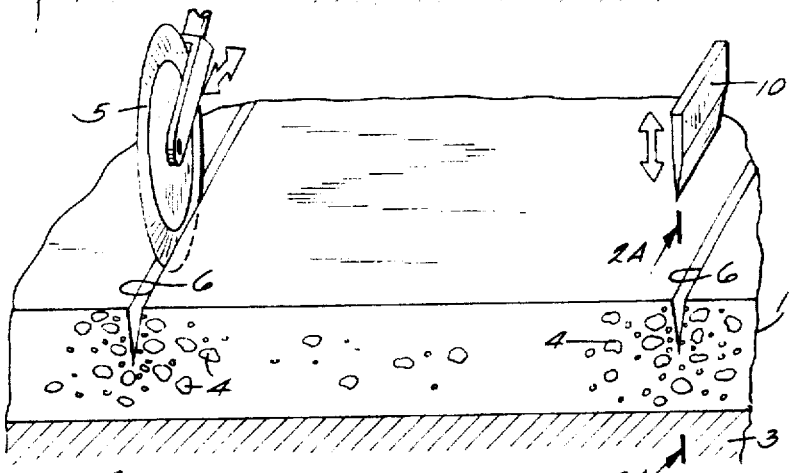
FIG. 2 of the drawings is a perspective view of the uncompacted asphalt mat that illustrates the step of scoring (in a direction transverse to the longitudinal direction of the mat) the still-warm, uncompacted asphalt mat.

FIG. 2 of the drawings shows one embodiment of the step of creating dormant zones of potential fracture at predetermined locations in the asphalt mat 1. The dormant zones of potential fracture are created in the asphalt mat through the use of a scoring tool or device 5. Although the device shown in the drawings is that of a single scoring wheel, a scoring tool having multiple wheels or any other tool which could effectively penetrate the asphalt mat and interrupt the aggregate interlock would be appropriate. One such alternative would include the scoring tool 10 in FIG. 2 which could be manually operated or appropriately mounted to a paver. In the preferred form of the invention, it is envisioned that scoring tools 5 or 10 may also be connected to a mechanical paving device or to a separate device to completely automate the process.

Also shown in FIG. 2 is the step wherein the continuous longitudinally extending asphalt mat 1 is scored to initiate the creation of a series of dormant zones of potential fracture. The scoring process displaces the aggregates 4 away from the area of the mat 1 wherever a dormant transverse zone of potential fracture is desired. The displacement of the aggregates, interrupts the normally occurring aggregate interlock. Preferably the interruption of the aggregate interlock should extend to one-third or more of the thickness of the asphalt mat. However, the depth of the score required will vary depending upon the thickness of the mat and the materials used. Under varying conditions it is expected that a score of one fourth of the thickness of the mat or less would work well.

The process of partially scoring the asphalt mat results not only in the simple separation of the aggregate, but also in the creation of the series of ravines, furrows, or temporarily open scores 6 extending generally, though not necessarily precisely, transversely across the longitudinally extending asphalt mat. The scores 6 are defined by oppositely facing side walls 7, 8 in the asphalt mat 1 at predetermined locations. During the scoring process, the aggregates are displaced in a horizontal direction into the oppositely facing side walls 7, 8.

The scoring process can occur at any desired longitudinally spaced intervals. The precise intervals chosen will be determined by the pavement cross section and traffic loading on the particular road. However, the preferred spacing of the scores 6 would be at intervals of between 0.3 ft. and 15 ft. In this fashion, the location of a series of dormant zones of potential fracture are created that would allow hairline cracking of the finished asphalt mat to occur whenever stress on the mat requires. Because of the frequent provision of the dormant zones of fracture, the stress induced cracking is free to continue until some equilibrium develops between the existence of stress on the mat, and the frequency of cracks that have developed along the dormant zones provided in the mat.

Figure 3:
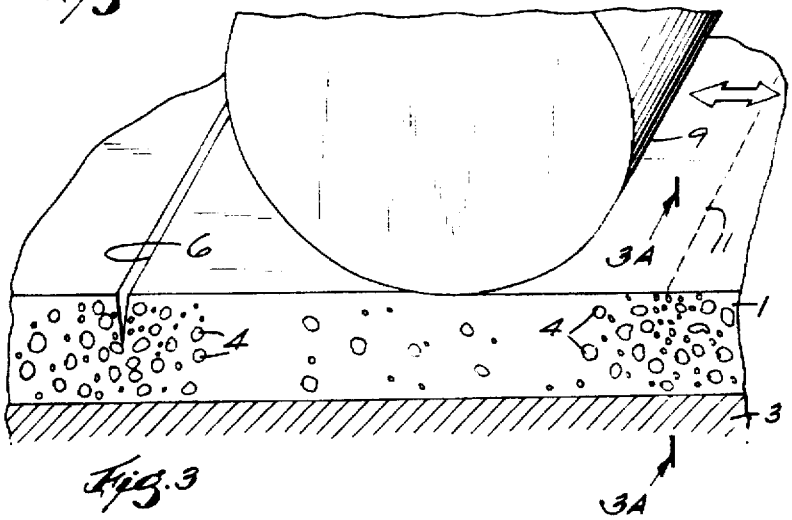
FIG. 3 of the drawings shows a perspective view of the asphalt mat being compacted to seal the discrete zones of potential fracture and provide a finished asphaltic pavement.
Figure 3A:
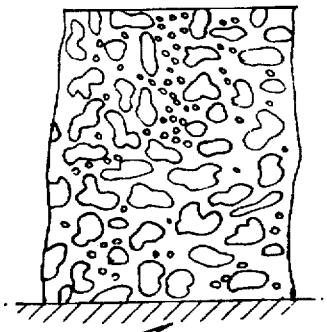
FIG. 3A of the drawings shows an enlarged, cut-away view of the scored compacted asphalt mat taken in area 3A—3A of FIG. 3 and illustrates the reestablishment of the interlock between the smaller size aggregate fractions and the liquid asphaltic cement.
Figure 4:
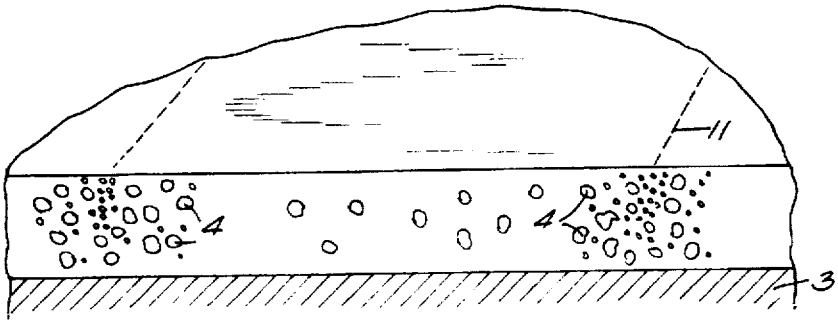
FIG. 4 of the drawings is a perspective view of the finished asphaltic pavement.

FIG. 3 of the drawings shows a conventional road roller 9 or compactor used to perform the step of compacting the mat of compactable asphaltic concrete to complete the formation of the dormant zone of potential fracture. The act of compacting the asphalt mat 1 after it has been scored to separate a portion of the aggregate interlock causes the side walls 7, 8 of each open score 6 to be compressed together creating a seal at the junction of the side walls (and where formerly the score existed). As shown in FIG. 3A, the seal is created by the rebonding of the asphalt cement and reestablishment of interlock only between the smaller aggregate size fractions and the liquid asphaltic cement. In this region, there is minimal, if any, reestablishment of the interlock of the larger sized aggregate fractions. In this fashion a sealed dormant zone of potential fracture is created in the asphalt mat. Though the dormant zone of potential fracture is substantially concealed in the pavement, some visible evidence of the zone may be detectable as a smooth crease 11. The visibility of the crease will be a factor of the particular composition of the asphalt used and the amount of compression applied to the mat.

As was previously discussed, in order to effectively create an asphalt mat 1 that will crack along the discrete zones of potential fracture in response to ambient stress on the asphalt mat, in the embodiment of the invention shown in FIGS. 1–4, it is desirable that the scoring process occur at longitudinally spaced intervals in the asphalt mat ranging from about 0.3 ft to 15 ft. By spacing the dormant zones of potential fracture at the aforementioned proximate longitudinal intervals, a plurality of closely spaced hairline cracks will develop in response to stress rather than wide cracks occurring at a longitudinal interval of approximately 20–30 ft. In this way, the amount of shrinkage is averaged over a larger number of transverse cracks. The importance of this lies in the fact that closely spaced cracks will be of the hairline type characterized by narrow widths as compared to the wide cracks which develop in a conventional asphalt mat. The benefit of having hairline cracks with a narrow width is that less moisture and dirt can work its way into the cracks to create additional maintenance problems. Additionally, during the summer months when the surface temperature of the asphalt mat may reach as high as 150°–180° Fahrenheit, the smaller sized transverse hairline cracks will tend to reseal themselves as the mixture of liquid asphaltic concrete and smaller aggregate sized fractions begin to flow as a viscous liquid across the zone of fracture. In this fashion, a crack which was once necessary to relieve stress on the asphalt mat has now been resealed.

Furthermore, because the dormant zones of potential fracture will respond to stress to produce hairline cracks, it may allow the use of a higher viscosity, and/or lower penetration value asphalt to produce a pavement having a service life that is even greater than the service life of existing asphalt pavement and also reduce the fumes given off by the asphalt during the paving process.

Figure 5:
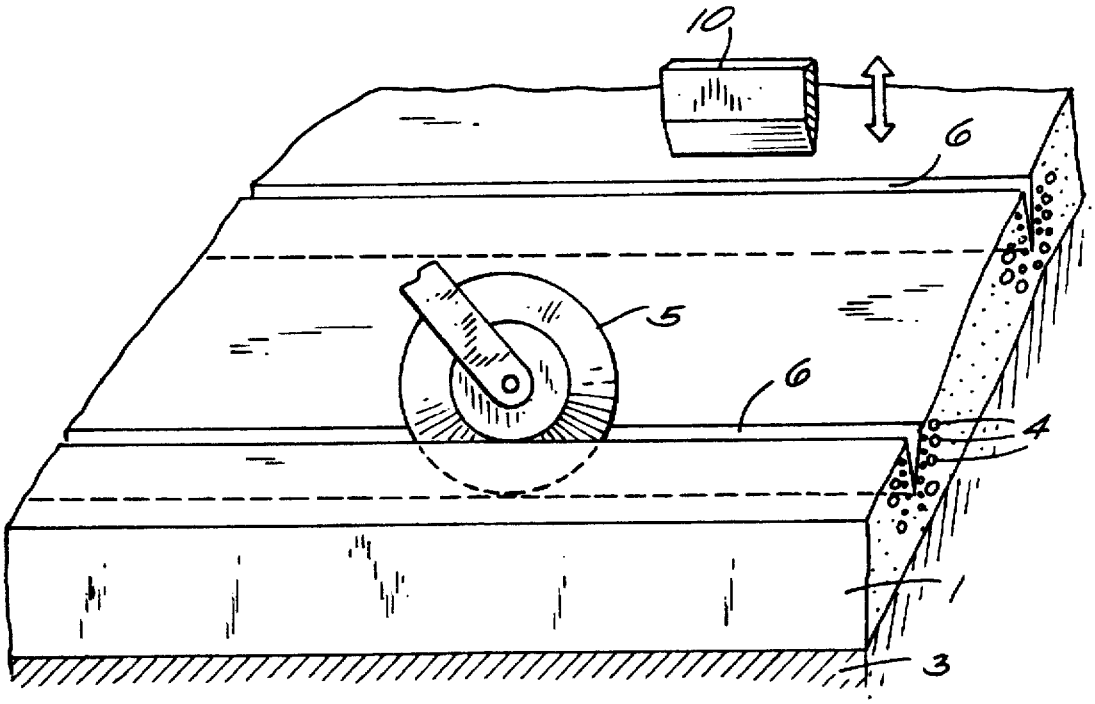
FIG. 5 of the drawings is a view similar to FIG. 3 showing an uncompacted asphalt mat having score lines separating the aggregate and extending in the longitudinal direction of the asphalt mat.
Figure 6:
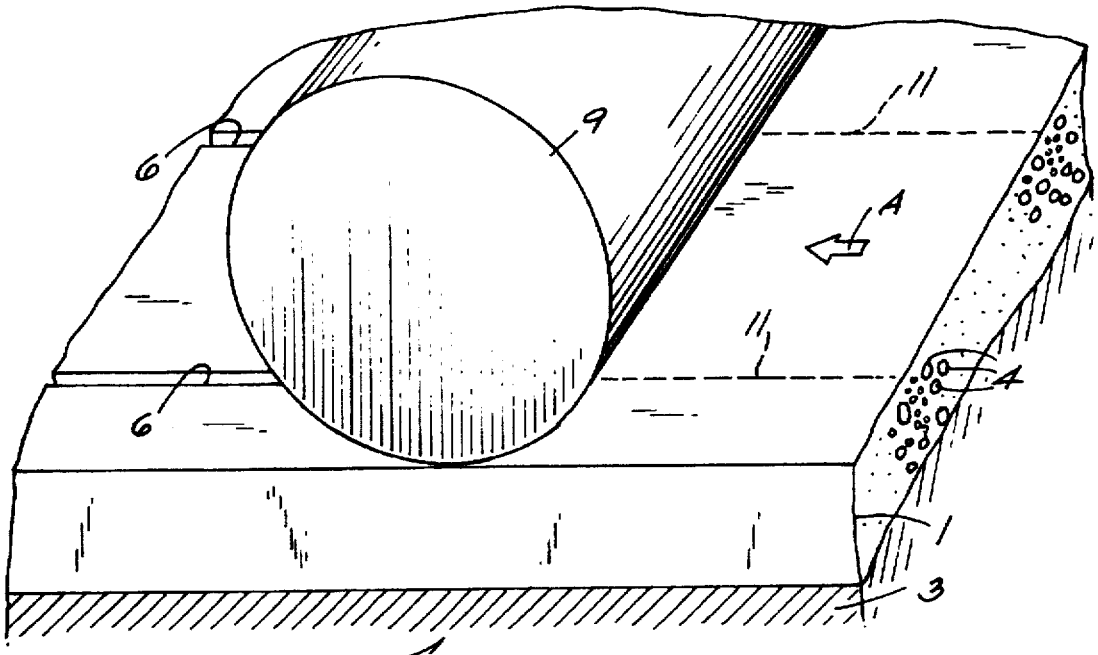
FIG. 6 of the drawings is a view similar to FIG. 4 showing the finished asphaltic pavement having longitudinally extending, sealed dormant zones of potential fracture.

FIGS. 5 and 6 are similar to FIGS. 2 and 3, respectively, but illustrate the process of creating dormant zones of potential fracture that are parallel to the longitudinal direction of the asphalt mat. Like items are identified using like reference numerals. As used herein "longitudinal direction" is intended to mean the direction extending along the centerline of the roadway in the direction of the roadway.

Figure 2A:
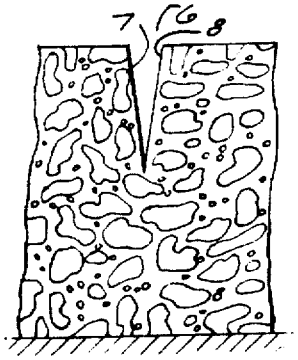
FIG. 2A of the drawing shows an enlarged, cut-away view of the scored, still-warm, uncompacted asphalt mat taken in area 2A—2A of FIG. 2 and illustrates the separation of the aggregate particles around the crevice and the existence of the aggregate interlock below the crevice.

The process of forming the dormant zones of potential fracture in a direction that is generally parallel to the longitudinal direction of the mat is essentially the same as the process of creating dormant zones of potential fracture transverse to the longitudinal direction of the asphalt mat described above and shown in FIGS. 1 through 4. As shown in the drawings, the process includes the step of forming on the sub-base 3 a continuous longitudinally extending mat 1 of compactable asphaltic paving concrete. Preferably, the mat has a predetermined thickness and is laid out so as to extend in a longitudinal direction (Arrow "A" in FIG. 6). The mat includes asphaltic cement and aggregates 4 comprising larger and smaller aggregate size fractions. The process also includes the step of displacing the asphaltic cement and the aggregates 4 in the mat 1 before compacting to separate the aggregate interlock as shown in FIG. 2A and create a plurality of longitudinally extending temporary open score lines 6. As shown in FIG. 5, the open score lines are formed so that they are generally parallel to the longitudinal direction of the asphalt mat at spaced intervals and so that they include oppositely facing sidewalls 6 and 7 (FIG. 24). The intervals are spaced transversely relative to the longitudinal direction of the asphalt mat so as to form, before compaction of the asphalt mat, a series of parallel, longitudinally extending open score lines 6 in the asphalt mat. The process also includes the step of compacting the mat of compactable asphaltic concrete to close and seal the open score lines 6 and to provide a finished asphaltic pavement of predetermined density having a smooth uninterrupted traffic bearing top surface including closed sealed score lines 11 defining a plurality of dormant zones of potential fracture substantially concealed at the spaced intervals. (See for example FIG. 3A which shows in cross-section a closed sealed score line wherein the aggregate interlock is disrupted, and FIG. 6 which shows a pair of longitudinally extending closed sealed score lines. The finished compacted asphalt pavement includes dormant zones of potential fracture that extend generally parallel to the longitudinal direction of the mat. The provision of the dormant zones of potential fracture extending generally parallel to the longitudinal direction of the mat reduces the amount and severity of the longitudinal joint cracking that would normally occur to an asphalt mat having longitudinal pavement joints that commonly occur at the centerline, between traffic lanes or strips of asphalt pavement, or at the joint between the traffic lane and the shoulder of the road as a result of the paving process.

Various features of the invention are set forth in the following claims.

What is claimed is:

1. A process for paving a sub-base surface with compactable asphaltic concrete including aggregates and an asphaltic cement to provide a finished asphaltic pavement having dormant zones of potential fracture at predetermined locations, the process for paving comprising the steps of:

a) forming on said sub-base surface a continuous longitudinally extending mat of compactable asphaltic paving concrete of predetermined thickness, the mat having a longitudinal direction and including asphaltic cement and aggregates;

b) displacing said asphaltic cement and said aggregates in said mat before compacting to create a plurality of spaced apart temporary open score lines extending generally parallel to said longitudinal direction; and c) compacting said mat of compactable asphaltic concrete to close and seal said open score lines and to provide a finished asphaltic pavement of predetermined density having a smooth uninterrupted traffic bearing top surface wherein said closed sealed score lines define a plurality of dormant zones of potential fracture substantially concealed at said spaced intervals, said dormant zones of potential fracture extending generally parallel to said longitudinal direction of said mat.

2. A process according to claim 1 wherein said aggregates include larger and smaller aggregate size fractions forming aggregate interlocks in said mat and wherein;

step b) further comprises the step of displacing all of said aggregates to interrupt all of said aggregate interlocks along said score lines in at least the top one third of said mat thickness; and step c) further comprises the step of compacting said mat to reestablish said aggregate interlocks between said smaller aggregate size fractions to create a region in said mat wherein there is minimal aggregate interlock of said larger aggregate size fractions thereby creating said dormant zone of potential fracture.

3. The process according to claim 1 wherein step b) further includes at least partially penetrating said mat thickness by a scoring tool to displace said aggregates and create opposed facing side walls defining said score in said mat; and step c) further includes compacting said scored mat to close said temporary open score lines and bond said opposed facing side walls together in sealed relation to provide at a plurality of sealed substantially concealed dormant zones of potential fracture in said finished pavement that are impervious to liquid unless fractured.

4. The process according to claim 3 wherein step b) further comprises causing said scoring tool to penetrate into said mat a distance equal to one third of the total thickness of said mat.

5. The process according to claim 3 wherein step b) further comprises moving said scoring tool to cause said aggregates to be displaced horizontally from said score line into said opposed facing side walls as said score line is being created.

6. The process according to claim 3 wherein:

step a) further comprises forming said mat of compactable asphaltic paving concrete as an unbroken mat of pavement; and step b) further includes creating said temporary score lines by moving said scoring tool parallel to said pavement mat to establish said dormant zones of potential fracture.

7. The process according to claim 1 wherein step b) further comprises spacing said score lines at spaced intervals in the range of 0.3 to 15 feet.

8. A process for paving a sub-base surface with compactable asphaltic concrete comprising aggregates forming aggregate interlocks, and an asphaltic cement to provide a finished longitudinally extending asphaltic pavement having dormant zones of potential fracture at predetermined spaced locations, the process comprising the steps of:

a) forming on said sub-base surface a continuous longitudinally extending mat of compactable asphaltic paving concrete of predetermined thickness, the mat having a longitudinal direction and comprising asphaltic cement and larger and smaller aggregate size fractions;

b) displacing said asphaltic cement and said aggregates to create a plurality of temporary open score lines in said mat before compacting to interrupt all of said aggregate interlocks along said score lines in at least the top one third of said mat thickness at said predetermined spaced locations, said open score lines being generally parallel to said longitudinal direction at said spaced locations; and c) compacting said mat of compactable asphaltic concrete to reestablish said aggregate interlocks between said smaller aggregate size fractions and to close and seal said open score lines and provide a finished asphaltic pavement of predetermined density having a smooth uninterrupted traffic bearing top surface wherein said closed sealed score lines define a plurality of longitudinally extending dormant zones of potential fracture substantially concealed at said spaced locations.

9. The process according to claim 8 wherein step b) further includes at least partially penetrating said mat thickness by a scoring tool to displace said aggregate and create opposed facing sidewalls defining said score lines in said mat at said spaced locations; and step c) further includes compacting said scored mat to close said temporary open score lines and bond said opposed facing sidewalls together in sealed relation to provide at least one sealed substantially concealed dormant zone of potential fracture in said finished pavement that is impervious to liquid unless fractured.

10. The process according to claim 9 wherein said step b) further comprises the step of causing said scoring tool to penetrate into said mat a distance equal to one third of the total thickness of said mat.

11. The process according to claim 9 wherein step b) further comprises moving said scoring tool to cause said aggregates to be displaced horizontally from said score line into said opposed facing side walls as said score line is being created.

12. The process according to claim 9 wherein:

step a) further comprises forming said mat of compactable asphaltic paving concrete as an unbroken mat of pavement; and step b) further includes creating said temporary score lines by moving said scoring tool generally parallel to the longitudinal direction of said pavement mat at said spaced locations to establish said dormant zones of potential fracture.

13. The process according to claim 8 wherein step b) further comprises spacing said score lines at spaced intervals in the range of 0.3 to 15 feet.

14. A process for paving a sub-base surface with compactable asphaltic concrete comprising aggregates forming aggregate interlocks, and an asphaltic cement to provide a finished asphaltic pavement having dormant zones of potential fracture at predetermined locations, the process comprising the steps of:

a) forming on said sub-base surface a continuous longitudinally extending mat of compactable asphaltic paving concrete of predetermined thickness, the mat having a longitudinal direction and comprising asphaltic cement and aggregates;

b) displacing said asphaltic cement and said aggregates in said mat by a scoring tool before compacting to create a plurality of temporary open score lines having opposed facing sidewalls and being generally parallel to said longitudinal direction at spaced intervals; and c) compacting said mat of compactable asphaitic concrete to close and seal said open score lines and bond said facing sidewalls together to provide a finished asphaltic pavement of predetermined density having a smooth uninterrupted traffic bearing top surface wherein said closed sealed score lines define a plurality of dormant zones of potential fracture that are substantially concealed at said spaced intervals and that are impervious to liquid unless fractured, said dormant zones of potential fracture extending generally parallel to said longitudinal direction.

15. A process according to claim 14 wherein said aggregates include larger and smaller aggregate size fractions forming aggregate interlocks in said mat and wherein;

step b) further comprises the step of displacing all of said aggregates to interrupt all of said aggregate interlocks along said score lines in at least the top one third of said mat thickness at said spaced intervals; and step c) further comprises the step of compacting said mat to reestablish said aggregate interlocks between said smaller aggregate size fractions to create a region in said mat wherein there is minimal aggregate interlock of said larger aggregate size fractions thereby creating said dormant zone of potential fracture.

16. The process according to claim 14 wherein step b) further comprises causing said scoring tool to penetrate into said mat a distance equal to one third of the total thickness of said mat.

17. The process according to claim 14 wherein step b) further comprises moving said scoring tool to cause said aggregates to be displaced horizontally from said score line into said opposed facing sidewalls as said score line is being created.

18. The process according to claim 14 wherein:

step a) further comprises forming said mat of compactable asphaltic paving concrete as an unbroken mat of pavement; and step b) further includes creating said temporary score lines by moving said scoring tool generally parallel to said pavement mat at said spaced intervals to establish said dormant zones of potential fracture.

19. The process according to claim 14 wherein step b) further comprises spacing said score lines at spaced intervals in the range of 0.3 to 15 feet.

* * * * *